US010971902B2

(12) United States Patent
Fuchs et al.

(10) Patent No.: US 10,971,902 B2
(45) Date of Patent: Apr. 6, 2021

(54) SPARK PLUG FOR A HIGH FREQUENCY IGNITION SYSTEM

(71) Applicant: Rosenberger Hochfrequenztechnik GmbH & Co. KG, Fridolfing (DE)

(72) Inventors: Martin Fuchs, Freilassing (DE); Michael Wollitzer, Fridolfing (DE); Gunnar Armbrecht, Mühldorf am Inn (DE); Peter Awakowicz, Bochum (DE); Thomas Musch, Bochum (DE); Sven Gröger, Bochum (DE); Andre Bergner, Bottrop (DE); Gordon Notzon, Bochum (DE); Marcel Van Delden, Bochum (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/304,056

(22) PCT Filed: Apr. 11, 2017

(86) PCT No.: PCT/EP2017/000480
§ 371 (c)(1),
(2) Date: Nov. 21, 2018

(87) PCT Pub. No.: WO2017/202482
PCT Pub. Date: Nov. 30, 2017

(65) Prior Publication Data

US 2020/0235552 A1 Jul. 23, 2020

(30) Foreign Application Priority Data

May 23, 2016 (DE) ..... 10 2016 006 350.5

(51) Int. Cl.
*H01T 13/46* (2006.01)
*H01T 13/22* (2006.01)

(52) U.S. Cl.
CPC ..... *H01T 13/462* (2013.01); *H01T 13/22* (2013.01)

(58) Field of Classification Search
CPC ..... H01T 13/46–467
See application file for complete search history.

(56) References Cited

U.S. PATENT DOCUMENTS

| | | | | |
|---|---|---|---|---|
| 1,318,391 A | | 10/1919 | Laughran | |
| 3,956,664 A | * | 5/1976 | Rado | H01T 13/462 315/58 |
| 4,004,562 A | * | 1/1977 | Rado | H01T 13/462 123/169 MG |
| 4,317,068 A | | 2/1982 | Ward et al. | |
| 7,098,581 B2 | * | 8/2006 | Cleeves | H01T 13/462 313/123 |

FOREIGN PATENT DOCUMENTS

| | | |
|---|---|---|
| DE | 2554517 A1 | 7/1976 |
| DE | 4020922 A1 | 1/1992 |

(Continued)

*Primary Examiner* — Mariceli Santiago
(74) *Attorney, Agent, or Firm* — David P. Dickerson

(57) ABSTRACT

The invention relates to a spark plug (100) for an internal combustion engine, in particular having a high frequency ignition system, having a central electrode (28; 128), a ground electrode (12; 112) and an electrical insulator (18; 118) arranged between the central electrode (28; 128) and the ground electrode (12; 112), wherein a central electrode connecting point (26; 126) for electrically connecting the central electrode (28; 128) to an ignition system is provided on the insulator (18; 118), wherein the central electrode (28; 128) and the ground electrode (12; 112) project beyond the insulator (18; 118) at an axial end (114) of the spark plug (100) and each form, with a part projecting axially beyond the insulator (18; 118), a central electrode end (140) and a ground electrode end (142), wherein the central electrode end (140) and the ground electrode end (142) are arranged and embodied in such a way that an axial region (170) of a (Continued)

gap (146) is formed between them in an axial direction, wherein the axial region (170) of the gap (146) is spaced apart from the insulator (18; 118), wherein at least one additional electrode (150) is provided which projects beyond the insulator (118) at the axial end (114) of the spark plug (100) and forms, with a part which projects axially beyond the insulator (118), an additional electrode end (154). In this case the additional electrode (150) is arranged electrically insulated from the ground electrode (112) and the central electrode (128), on the spark plug (100), wherein the additional electrode end (154) projects into the axial region (170) of the gap (146) between the central electrode end (140) and the ground electrode end (142) or is arranged into a region (170) of the gap (146) which is radially adjacent to the axial region (170) of the gap (146), and as a result divides the gap (146) into two ignition spark end gaps (156, 166).

20 Claims, 6 Drawing Sheets

(56) References Cited

FOREIGN PATENT DOCUMENTS

| | | | |
|---|---|---|---|
| DE | 19843712 | A1 | 3/1999 |
| DE | 102004058925 | A1 | 6/2006 |
| DE | 102008051185 | A1 | 12/2009 |
| DE | 112008000989 | T5 | 2/2010 |
| DE | 102013215663 | A1 | 9/2014 |
| EP | 0134355 | A1 | 3/1985 |
| EP | 0464353 | A1 | 1/1992 |
| GB | 670979 | A | 4/1952 |
| JP | 2005061310 | A | 3/2005 |
| JP | 2009164089 | A | 7/2009 |

* cited by examiner

SPARK PLUG FOR A HIGH FREQUENCY IGNITION SYSTEM

The invention relates to a spark plug for an internal combustion engine, in particular having a high frequency ignition system, having a central electrode, a ground electrode and an electrical insulator arranged between the central electrode and the ground electrode, wherein a central electrode connecting point for electrically connecting the central electrode to an ignition system is provided on the insulator, wherein the central electrode and the ground electrode project beyond the insulator at an axial end of the insulator and each form, with a part projecting axially beyond the insulator, a central electrode end and a ground electrode end, wherein the central electrode end and the ground electrode end are arranged and embodied in such a way that an axial region of a gap is formed between them in an axial direction so as to be spaced apart from the insulator, as per the preamble of patent claim 1.

Spark plugs have the function in internal combustion engines of igniting a fuel/fuel or air/fuel mixture in a combustion chamber by means of sparks which jump over between the plug electrodes. For this purpose, the ignition voltage must be introduced into the combustion chamber in a well-insulated fashion.

Known spark plugs 10, as illustrated for example in FIG. 1 and known, for example, from DE 198 43 712 A1, conventionally have a metallic tubular housing 12 which surrounds in a sealed fashion, at its ignition side end 14, a ground electrode 16 and an insulating body 18 with its inner borehole. The tubular housing 12 has activation means, for example in the form of a hexagonal head 20 and an outer thread 22, with which the spark plug 10 is secured in a seal forming fashion in a plug bore in an engine block. The insulating body 18 is sealed with respect to the metallic housing 12 at, for the most part, a plurality of points, and has a longitudinal bore, into which a connecting bolt 24 for an ignition cable which is to be secured thereto or for an ignition coil (not illustrated) which is to be directly attached projects on the connection side 26. On the ignition side 14, a central electrode 28, which runs in the longitudinal direction through the insulating body 18 and is separated from the ground electrode 16 by a spark gap, is arranged in the insulating body bore. The central electrode 28 is frequently manufactured from an electrically conductive sintered material owing to the improved burn off resistance. The insulating body 18 is generally fabricated from ceramic. Internal seals 30 with a talcum ring seal the insulating body 18 against the housing 12. An outer sealing ring 32 seals a seat of the spark plug in the mounted state. Furthermore, an interference suppression resistor 34 is arranged in the course of the central electrode 28. The insulating body 18 is equipped on its outer circumference with a creepage current barrier 36.

In order to ensure a high level of safety and freedom from faults of the ignition of an air/fuel mixture in accordance with regulations, it must be ensured that the spark gap formed between the central electrode and the ground electrode is not adversely affected by disruptive partial discharges at other locations on the spark plug. However, in particular when air/fuel mixtures are ignited by means of high frequency, what are referred to as sliding discharges can occur on the surface of the insulating body in the case of the conventional use of ceramic insulators, which sliding discharges adversely affect not only the safety and freedom from faults of the ignition but also can even give rise to local destruction of the spark plug.

DE 11 2008 000 989 T5 discloses a spark plug which has a central electrode and two ground electrodes, wherein a ground electrode defines a radial ignition spark gap with the central electrode, and the other ground electrode defines an axial ignition spark gap with the central electrode.

DE 198 43 712 A1 proposes providing, in addition to a grounding electrode and a central electrode, a bypass electrode which connects the grounding electrode and the central electrode electrically to one another and is fabricated from a semiconductor material. By applying an ignition voltage between the central electrode and the grounding electrode a capacitive discharge is executed via the bypass electrode, and then an inductive discharge is executed by means of an inductive ignition gap.

What are referred to as spark ignition combustion methods with direct injection of the fuel possess a large potential in terms of the reduction of consumption by virtue of the possibility of forming a stratified charge in the combustion chamber. However, the non homogenous mixture in the combustion chamber makes increased demands of the ignition method used in terms of reliable ignition at the suitable time. Fluctuations of any type degrade, for example, the quality of the ignition and therefore the efficiency of the entire engine. On the one hand, the position of the ignitable mixture can vary slightly and, on the other hand, the hook of a ground electrode of the spark plug can have a disruptive effect on the mixture formation. An ignition system with a relatively large spatial extent into the combustion chamber is helpful for a directly injecting combustion method. For this purpose, DE 10 2004 058 925 A1 proposes igniting a fuel/air mixture in a combustion chamber of an internal combustion engine by means of plasma. A corresponding high frequency plasma ignition device comprises a series oscillation circuit with an inductor and a capacitor and a high frequency source for the resonant excitation of this series oscillation circuit. The capacitor is formed by internal and external conductor electrodes with a dielectric located between them. These electrodes extend with their outermost ends, with a predefined distance between them, into the combustion chamber.

DE 10 2008 051 185 A1 discloses an ignition method, in which a discharge plasma is generated by means of a direct-voltage pulse and is subsequently ionized by means of a high frequency field. The direct voltage pulse and an output signal of a high frequency generator are fed here together to a spark electrode of a spark plug. A corresponding electrode of the spark plug is grounded.

Modern ignition systems for spark ignition engines nowadays have a spark plug and an individual ignition coil with an electronic actuation unit. The spark plug is a coaxial structure and is composed essentially of a central electrode surrounded by an insulator and an outer electrode which is connected to the spark plug casing. The ignition coil supplies a high voltage pulse to the spark plug. A spark which initiates the combustion is produced between the electrodes. An alternative method in which, in addition to the applied high voltage of the ignition coil, a high frequency voltage is applied to the spark plug in order to lengthen the spark duration is described in DE 10 2013 215 663 A1.

The invention is based on the object of improving a spark plug of the abovementioned type in terms of the ignition reliability and function.

This object is achieved according to the invention by means of a spark plug of the abovementioned type having the features characterized in claim 1. Advantageous refinements of the invention are described in the further claims.

For this purpose, according to the invention, in a spark plug of the abovementioned type there is provision that at least one additional electrode is provided which is arranged electrically insulated from the ground electrode and the central electrode, on the spark plug, and projects beyond the insulator at the axial end of the insulator and forms, with a part which projects axially beyond the insulator, an additional electrode end, wherein the additional electrode end projects into the axial region of the gap between the central electrode end and the ground electrode end or into a region of the gap which is radially adjacent to the axial region of the gap.

This has the advantage that a spark plug with three electrodes which can be connected independently of one another to an ignition system is available and can be used in conventional internal combustion engines without or with, at any rate, small modifications, for example to the spark plug connector, and permits the use or the retrofitting of a high frequency ignition system in conventional internal combustion engines. The axial region of the gap between the central electrode end and the ground electrode end or the region of the gap which is radially adjacent to the axial region of the gap is respectively divided into two ignition spark gaps by the additional electrode.

Compatibility of the spark plug with conventional spark plug receptacles in a conventional cylinder head is achieved by virtue of the fact that the ground electrode is embodied as a metal housing which surrounds the insulator in a predetermined axial section, and wherein a thread is arranged at an axial end, facing the ground electrode end, of the metal housing.

A seal between a space into which the electrode ends project and the surroundings is achieved by virtue of the fact that at least one inner seal is arranged between the metal housing and the insulator, and at least one outer seal, in particular a sealing ring, is arranged on the metal housing.

A particularly compact design of the spark plug is obtained by virtue of the fact that the first ignition spark gap extends in an axial direction along a longitudinal axis of the central electrode.

A double air spark spark plug with improved ignition properties is obtained by virtue of the fact that the central electrode end and the additional electrode end are arranged and embodied in such a way that between them a second ignition spark gap is formed in an axial direction spaced apart from the insulator, wherein the second ignition spark gap extends in an axial direction along a longitudinal axis of the central electrode, and wherein the first and second ignition spark gaps are arranged aligned with one another in an axial direction.

Reliable generation of an air spark between the central electrode and the additional electrode as well as between the additional electrode and the ground electrode when a high voltage is applied only to the central electrode is achieved by virtue of the fact that the ignition spark gaps (156, 166) are at least 0.2 mm long.

A particularly compact design of the spark plug with controlled impedance for the high-frequency signal which is applied between the central electrode and the additional electrode is achieved in that the additional electrode is arranged radially within the insulator and extends there essentially parallel to the ground electrode and is spaced apart radially therefrom, wherein an additional electrode connecting point for electrically connecting the additional electrode to an ignition system is provided on the insulator. The impedance of the high-frequency feedlines in the spark plug with respect to the electrode ends is dependent essentially on the distance between the additional electrode and the ground electrode as well as the permittivity of the filler material.

Improved stabilization of the impedance is achieved by virtue of the fact that the additional electrode end is embodied as a closed loop which starts at the additional electrode and enters the insulator again and extends there as a further additional electrode parallel and with constant spacing with respect to the ground electrode and radially within the insulator, wherein the further additional electrode is electrically connected to the additional electrode connecting point.

A particularly simple and cost effective manufacture of the spark plug is achieved by virtue of the fact that the additional electrode end is embodied in an L shape and has a free end.

Particularly simple and cost effective manufacture of the spark plug is achieved by virtue of the fact that the ground electrode end is embodied in an L shape and has a free end.

Improved stabilization of the impedance is achieved by virtue of the fact that the ground electrode end is embodied as a closed loop which starts and ends at the ground electrode.

The invention will be explained in more detail below on the basis of the drawing, in which.

Figure 1:
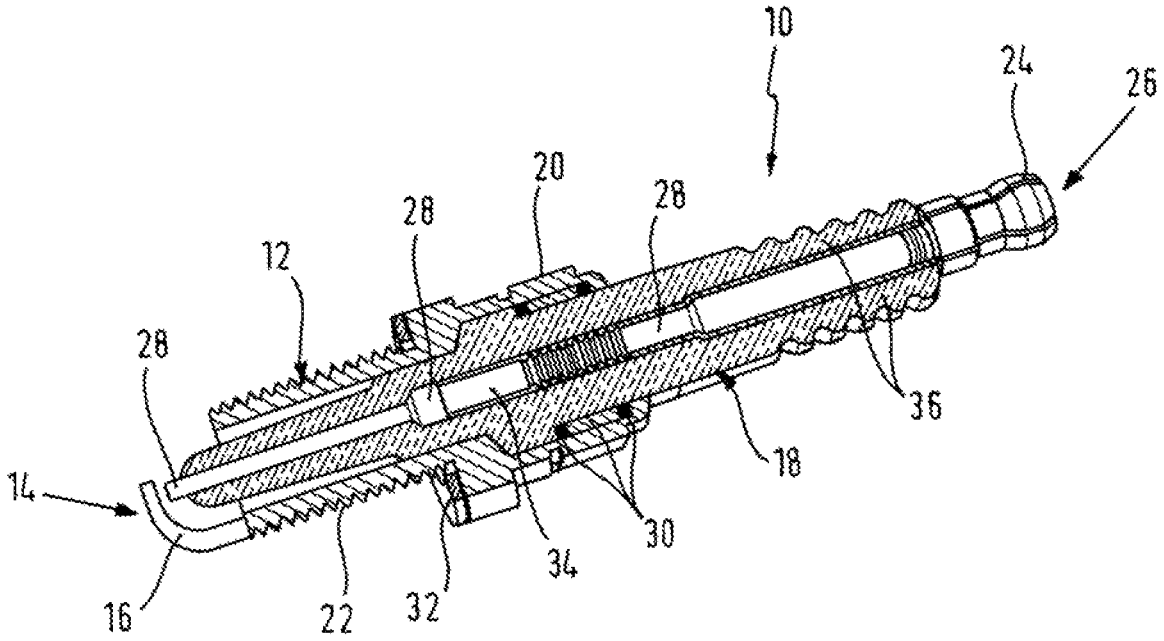
Fig. 1 (Prior Art)
FIG. 1 shows a spark plug, known from the prior art, for internal combustion engines in a sectional view.
Figure 2:
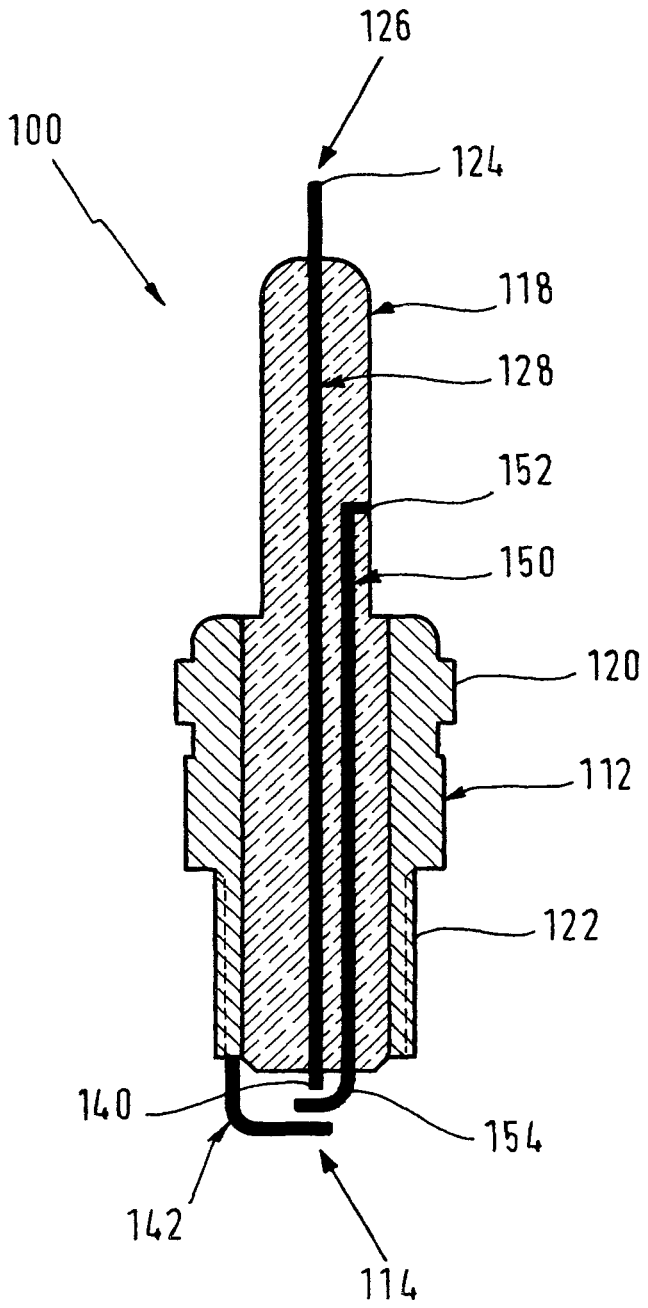
FIG. 2 shows a first preferred embodiment of a spark plug according to the invention in a sectional view.

The first preferred embodiment of a spark plug 100 according to the invention, which is illustrated in FIGS. 2 and 3, comprises a central electrode 128 and a ground electrode 112 in the form of a metal housing which surrounds an insulating body 118 over a predetermined axial section and has an external thread 122 at an ignition side end 114, and a central electrode connecting point 124, at a connection side end 126, for electrically connecting the central electrode 128 to an ignition system (not illustrated). Furthermore, a hexagonal 120 is formed on the ground electrode 112 in the form of the metal housing, which hexagonal 120 serves for the engagement of a tool (spark plug key) for mounting and removing the spark plug on or from an engine block of an internal combustion engine.

The central electrode 128 is arranged in the insulating body 118, is electrically connected to the central electrode connecting point 124 at the connection side end 126 of the spark plug 100 and projects at the ignition side end 114 in the axial direction beyond the insulating body 118 with a part which forms a central electrode end 140. The central electrode end 140 is embodied in a linear fashion, is electrically connected to the central electrode 128 and extends along a central longitudinal axis 144 of the central electrode 128. The central electrode end 140 is arranged coaxially with respect to the central longitudinal axis 144. Alternatively, the central electrode 128 can also be arranged eccentrically with respect to the central longitudinal axis 144.

The ground electrode 112 has, at the ignition side end 114, a part which forms a ground electrode end 142, which projects beyond the insulating body 118 in the axial direction and is electrically connected to the ground electrode 112, i.e. to the metal housing. The ground electrode end 142 is embodied in an L shape and extends in such a way that it intersects the central longitudinal axis 144. In this way, an axial region 170 of a gap 146 is formed and defined along the central longitudinal axis 144 and spaced axially apart from the insulating part 118, between the central electrode 128 and the ground electrode 112 and/or between the central electrode end 140 and the ground electrode end 142.

According to the invention, an additional electrode 150 is additionally provided, which is arranged on the spark plug 100, electrically insulated from the central electrode 128 and the ground electrode 112. The additional electrode 150 is arranged in the insulating body 118 and runs in the insulating body 118 spaced radially apart from and in parallel with the central electrode 128. An additional electrode connecting point 152, which is electrically connected to the additional electrode 150 and serves to electrically connect the additional electrode 150 to an ignition system, is arranged at or near to the connection side end 126 on the insulating body 118. An additional electrode end 154, which is electrically connected to the additional electrode 150 and projects beyond the insulating body 118 in the axial direction, is arranged at the ignition side end 114 of the spark plug 100. The additional electrode end 154 is embodied in an L shape and extends in such a way that in an alternative illustrated in FIG. 3A it projects into the axial region 170 of the gap 146 between the central electrode end 140 and the ground electrode end 142. In this way, a second ignition spark gap 156 between the central electrode 128 and the additional electrode 150 or between the central electrode end 140 and the additional electrode end 154 is formed and defined along the central longitudinal axis 144 and at an axial distance from the insulating part 118, and a first ignition spark gap 166 is formed or defined between the additional electrode 150 and the ground electrode 112 or between the additional electrode end 154 and the ground electrode end 142. The length of the second ignition spark gap 156 is smaller or shorter here than the length of the first ignition spark gap 166, as is immediately apparent from FIG. 3A and FIG. 3B, respectively.

Figure 3A:
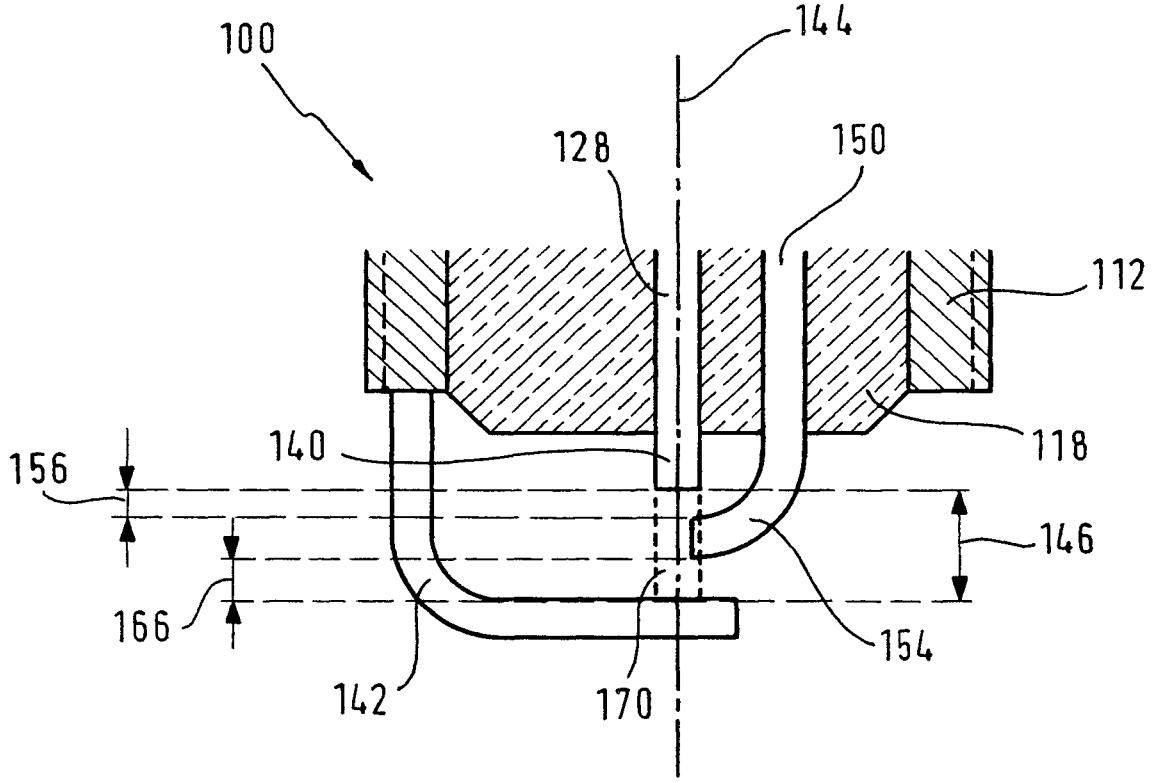
FIG. 3A shows an enlarged detail of an ignition-side end of the spark plug according to FIG. 2 in a sectional view with an additional electrode which projects into the axial region of the gap.
Figure 3B:
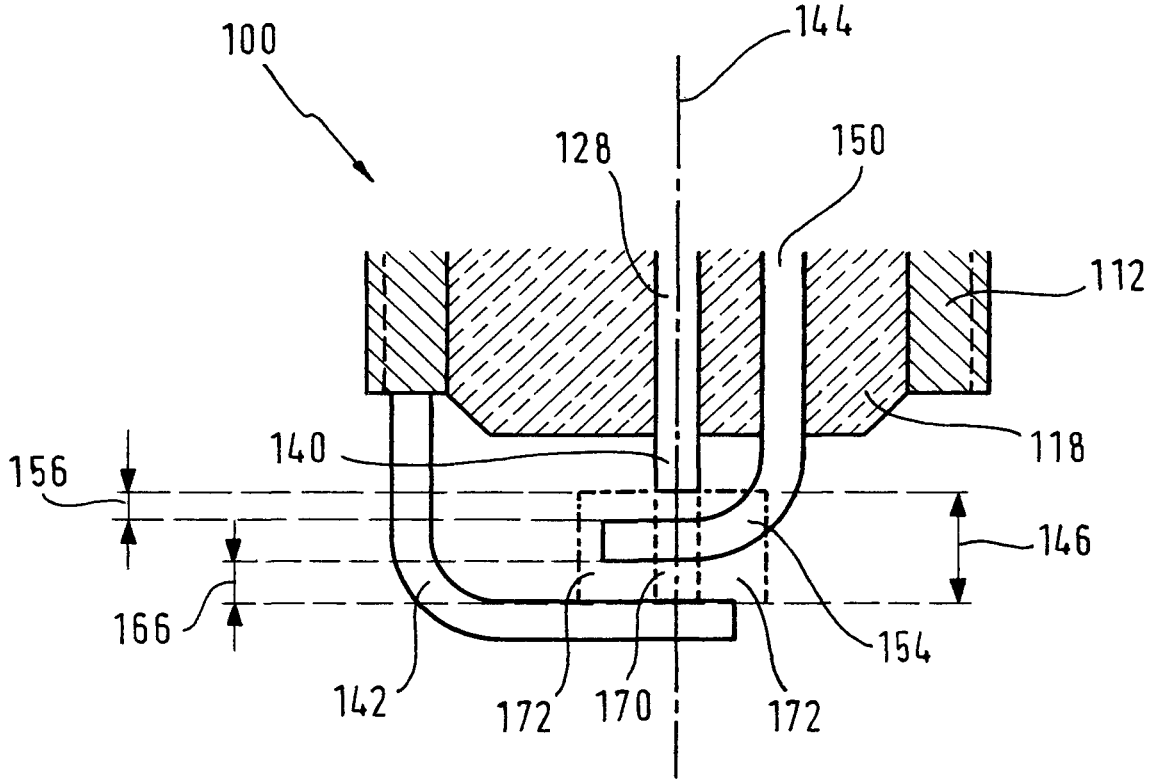
FIG. 3B shows an enlarged detail of an ignition side end of the spark plug according to FIG. 2 with an additional electrode which projects into a region of the gap which is radially adjacent to the axial region of the gap.

FIG. 3B shows a second alternative, wherein identical reference symbols denote functionally identical parts as in FIG. 3A, with the result that for the explanation thereof reference is made to the above description of FIG. 3A. In the second alternative illustrated in FIG. 3B, the additional electrode end 154 is also embodied in an L shape and extends as far as a region 172 of the gap 146 which is radially adjacent to the axial region 170 of the gap 146. The additional electrode end 154 intersects here the central longitudinal axis 144 between the central electrode end 140 and the ground electrode end 142 (as illustrated in FIG. 3B), or else does not do so.

With respect to the ignition spark gap or gaps, what has been stated above with respect to the first alternative applies analogously to the second alternative.

Figure 4:
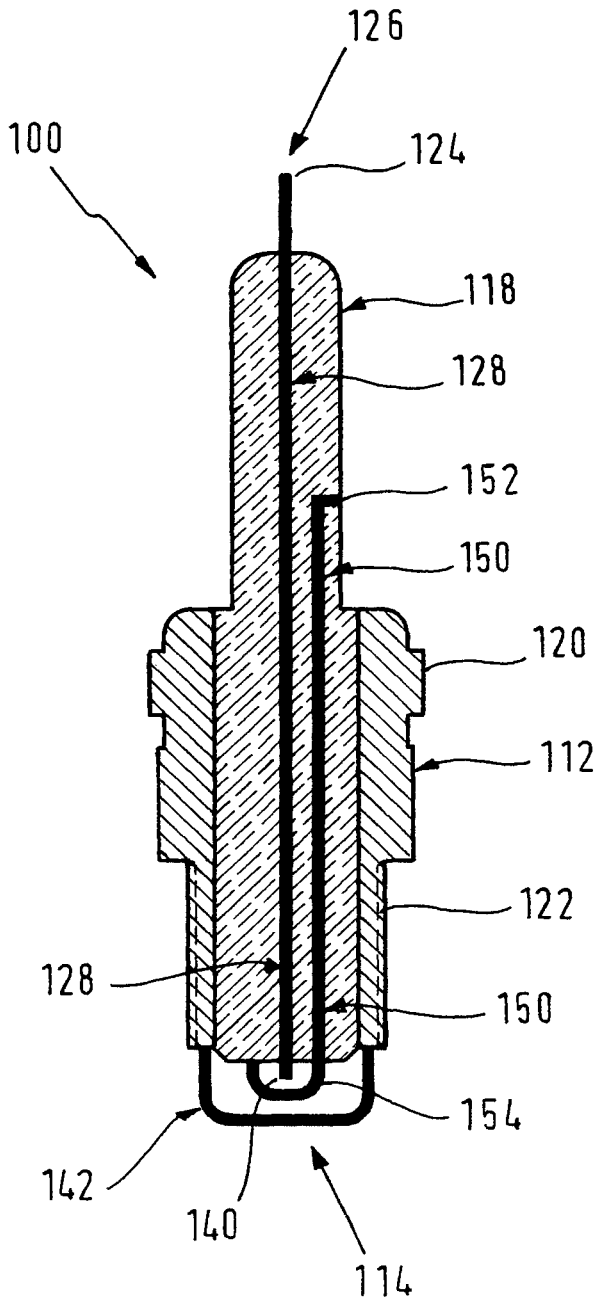
FIG. 4 shows a second preferred embodiment of a spark plug according to the invention in a sectional view.

FIG. 4 shows a second preferred embodiment of a spark plug 100 according to the invention. In FIG. 4 functionally identical parts are denoted by the same reference symbols as in FIGS. 2 and 3, and for the explanation thereof reference is therefore made to the above description of FIGS. 2 and 3. In contrast to the first embodiment according to FIGS. 2 and 3, in the second embodiment according to FIG. 4 the additional electrode end 154 and the ground electrode end 142 are formed as a closed loop without a free end at the ignition side end 114 of the spark plug 100. In this context, the loop of the ground electrode end 142 starts and ends at the ground electrode 112 or the metal housing which forms the ground electrode 112. The loop of the additional electrode end 154 starts from the additional electrode 150 at the insulating body 118 and ends at the insulating body 118 spaced radially apart from the starting point of the loop of the additional electrode end 154 on the insulating body 118. This brings about stabilization of the impedance when the spark plug 100 according to the invention is used with a high frequency ignition system (not illustrated).

Figure 5:
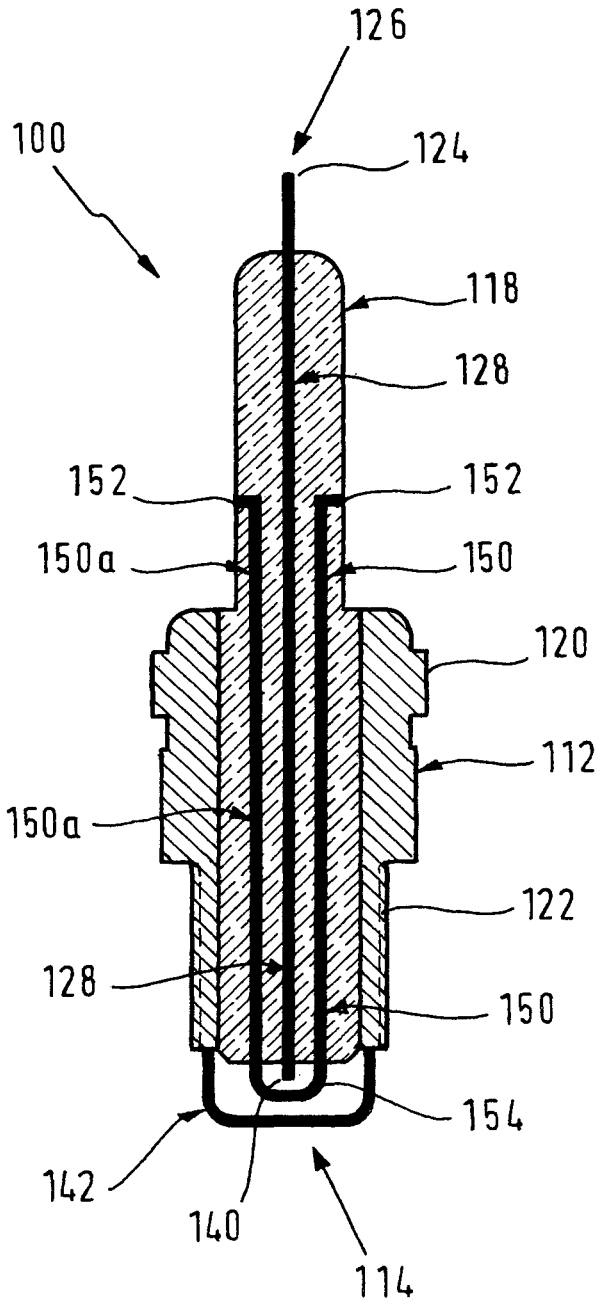
FIG. 5 shows a third preferred embodiment of a spark plug according to the invention in a sectional view.

FIG. 5 shows a third preferred embodiment of a spark plug 100 according to the invention. In FIG. 5 functionally identical parts are denoted by the same reference symbols as in FIGS. 2, 3 and 4, and for the explanation thereof reference is therefore made to the above description of FIGS. 2, 3 and 5. In contrast to the second embodiment according to FIG. 4, in the third embodiment according to FIG. 5 a further additional electrode 150*a* is provided which is arranged in the insulating body 118 and runs essentially parallel to the central electrode 128 and spaced radially apart therefrom. The loop of the additional electrode end 154 starts from the additional electrode 150 on the insulating body 118 and ends at the insulating body 118, wherein this loop is electrically connected to the further additional electrode 150*a* here. Furthermore, the further additional electrode 150*a* is electrically connected to the additional electrode connecting point 152. The additional electrode connecting point 152 is formed, for example in an annular shape, on the outer circumference of the insulating body 118, and in this way electrical contact can be formed with it by a corresponding additional electrical contact in a spark plug connector (not illustrated). This brings about further stabilization of the impedance when the spark plug 100 according to the invention is used with a plasma ignition system (not illustrated).

Alternatively, the additional electrode 150 and the further additional electrode 150*a* are embodied in one piece in the insulating body as a tube or in a rotationally symmetrical fashion and are arranged coaxially with respect to the central electrode 128.

The method of functioning of the spark plug 100 according to the invention is described below in accordance with FIGS. 2 to 5 which are explained by way of example above. By applying a high voltage pulse to the central electrode 128, a double air gap is brought about between the central electrode 128 and the additional electrode 150 or between the central electrode end 140 and the additional electrode end 154, on the one hand, and the additional electrode 150 and the ground electrode 112 or the additional electrode end 154 and the ground electrode end 142, on the other. Depending on the ignition system or ignition circuit which is connected, the additional electrode 150 is passive or active. In this context, the additional electrode 150, for example, is electrically connected to ground (single spark), electrically connected to an electrical capacitance (passive) or electrically connected to a high frequency amplifier (active). In the latter case, electrical high frequency (HF) energy is applied via the additional electrode 150, with the result that plasma is excited from the ignition spark, which plasma is then correspondingly produced at the ignition side end 114 of the spark plug 100 and is maintained until the supply of the high frequency energy is ended.

When the spark plug 100 is used with a high frequency ignition system which has a high voltage source (high direct-voltage source), such as, for example, an ignition coil, and a high frequency voltage source, the central electrode

128 is a high voltage electrode which is provided for electrical connection to the high voltage source of the high frequency ignition system. In this way, a brief electrical high voltage (electrical high voltage pulse or high direct voltage pulse DC) which is generated by the high voltage source is fed to the central electrode 128 and gives rise there to an ignition spark between the central electrode 128 and the additional electrode 150 and/or between the central electrode end 140 and the additional electrode end 154, on the one hand, and the additional electrode 150 and the ground electrode 112 and/or the additional electrode end 154 and the ground electrode end 142 (double air spark), on the other. This ignition spark causes plasma to be generated between the central electrode 128 and the ground electrode 112 via the additional electrode 150 and/or between the central electrode end 140 and the ground electrode end 142 via the additional electrode end 154 in the first and second ignition spark gaps 166, 156. The expression "electrical high direct voltage pulse" denotes here an electrical direct voltage pulse with high electrical energy of, for example, 8 kV to 12 kV.

The additional electrode 150 is a high frequency electrode which is provided for electrical connection to the high frequency source of the high frequency ignition system. In this way, an electrical high frequency voltage which is generated by the high frequency source is fed to the additional electrode 150 and brings about further heating there of the plasma which is generated in advance by the ignition spark on the basis of the high direct voltage pulse, with the result that this plasma can be maintained over a certain time period between the additional electrode 150 and the ground electrode 112 and/or between the additional electrode end 154 and the ground electrode end 142 and/or in a space around the additional electrode end 154 and the ground electrode end 142, wherein this time period is significantly longer (up to several milliseconds) than that time period in which the actual ignition spark would be present (several nanoseconds). Therefore, plasma for igniting an air/fuel mixture is present at the ignition side end 126 between the additional electrode 150 and the ground electrode 112 and/or between the additional electrode end 154 and the ground electrode end 142 and/or in a space around the additional electrode end 154 and the ground electrode end 142, over a time period of longer than several nanoseconds, and the ignition of the air/fuel mixture takes place more reliably and also with very much leaner air/fuel mixtures and a high exhaust gas feedback rate, in cases in which the conventional ignition spark alone would no longer reliably ensure ignition of the air/fuel mixture, or under certain circumstances would even no longer ensure ignition at all.

The stabilization of the impedance of the high frequency plasma is more important than a constant impedance of the axial feed line. This requires spatial stabilization of the high frequency plasma. This is done by providing the most equidistant possible distance between the additional electrode end 154 and the ground electrode end 142 between which the high frequency plasma fires. Here, not only brackets are conceivable as a structure but also, for example, perforated hemispheres etc. The high frequency plasma can therefore be protected against dispersal, which results in an undesired change in the impedance of the high frequency plasma. The intermediate electrode 150 may even not be oriented axially for structural reasons.

The invention claimed is:

1. A spark plug, comprising:

an insulator;

a first electrode comprising a first contact portion exterior to said insulator at a first terminal end of said first electrode and a first tip portion exterior to said insulator at a second terminal end of said first electrode;

a second electrode comprising a second contact portion exterior to said insulator at a first terminal end of said second electrode and a second tip portion exterior to said insulator at a second terminal end of said second electrode; and a third electrode comprising a third contact portion at a first end of said third electrode and a third tip portion at a second end of said third electrode, wherein said first electrode is of a material and dimension to conduct electrical current such that a voltage at said first tip portion substantially equals a voltage at said first contact portion, said second electrode is of a material and dimension to conduct electrical current such that a voltage at said second tip portion substantially equals a voltage at said second contact portion, and an imaginary line coaxial to a longitudinal axis of said first tip portion intersects said second tip portion and said third tip portion.

2. The spark plug of claim 1, wherein:

said second electrode and said third electrode define a first spark gap between said second tip portion and said third tip portion, and said first electrode and said second electrode define a second spark gap between said first tip portion and said second tip portion.

3. The spark plug of claim 1, wherein:

a minimum distance from said first tip portion to said second tip portion is smaller than a minimum distance from said second tip portion to said third tip portion.

4. The spark plug of claim 1, wherein:

said insulator comprises a first end portion, a second end portion and a central portion intermediate said first end portion and said second end portion.

5. The spark plug of claim 4, wherein:

said first electrode extends through said insulator from said first end portion to said second end portion, and said second electrode extends through said insulator from said first end portion to said second end portion.

6. The spark plug of claim 4, wherein:

said first contact portion protrudes from said first end portion, and said second contact portion is exposed at said first end portion without substantially protruding from said insulator.

7. The spark plug of claim 4, wherein:

said first tip portion protrudes from said second end portion, and said second tip portion protrudes from said second end portion.

8. The spark plug of claim 1, comprising:

a metallic casing on an outer circumference of said insulator.

9. The spark plug of claim 8, wherein:

said insulator comprises a first end portion, a second end portion and a central portion intermediate said first end portion and said second end portion, and an outer circumference of said metallic casing comprises a thread, a plane perpendicular to a longitudinal axis of said insulator intersecting said thread and said central portion.

10. The spark plug of claim 8, wherein:

said third contact portion electrically contacts said metallic casing.

11. A spark plug, comprising:

an insulator;

a first electrode comprising a first ignition voltage input terminal outside said insulator and a first spark-gap portion;

a second electrode comprising a second ignition voltage input terminal outside said insulator and a second spark-gap portion; and a ground electrode comprising a contact portion and a third spark-gap portion, wherein said first electrode and said second electrode define a first spark gap between said first spark-gap portion and said second spark-gap portion, said first electrode is insulated from said second electrode such that an electric potential at said first ignition voltage input terminal is substantially independent of an electric potential at said second ignition voltage input terminal except as influenced via said first spark gap, and an imaginary line coaxial to a longitudinal axis of said first electrode intersects said second spark-gap portion and said third spark-gap portion.

12. The spark plug of claim 11, wherein:

said second electrode and said ground electrode define a second spark gap between said second spark-gap portion and said third spark-gap portion.

13. The spark plug of claim 11, wherein:

a minimum distance from said first spark-gap portion to said second spark-gap portion is smaller than a minimum distance from said second spark-gap portion to said third spark-gap portion.

14. The spark plug of claim 11, wherein:

said first electrode extends through said insulator, and said second electrode extends through said insulator.

15. The spark plug of claim 11, wherein:

said first ignition voltage input terminal protrudes from said insulator, and said second ignition voltage input terminal is exposed at an outer surface of said insulator without substantially protruding from said insulator.

16. The spark plug of claim 11, wherein:

said first spark-gap portion protrudes from said insulator, and said second spark-gap portion protrudes from said insulator.

17. The spark plug of claim 11, comprising:

a metallic casing on an outer circumference of said insulator, wherein said contact portion electrically contacts said metallic casing.

18. The spark plug of claim 17, wherein:

an outer circumference of said metallic casing comprises a thread.

19. A spark plug, comprising:

an insulator;

a first electrode comprising a first contact portion exterior to said insulator at a first terminal end of said first electrode and a first tip portion exterior to said insulator at a second terminal end of said first electrode;

a second electrode comprising a second contact portion exterior to said insulator at a first terminal end of said second electrode and a second tip portion exterior to said insulator at a second terminal end of said second electrode; and a third electrode comprising a third contact portion at a first end of said third electrode and a third tip portion at a second end of said third electrode, wherein said first contact portion is not in electrical contact with said second contact portion, and an imaginary line coaxial to a longitudinal axis of said first tip portion intersects said second tip portion and said third tip portion.

20. The spark plug of claim 1, wherein:

a minimum distance from said first tip portion to said second tip portion is smaller than a minimum distance from said second tip portion to said third tip portion.

* * * * *